US009124047B2

(12) United States Patent
Kanda

(10) Patent No.: US 9,124,047 B2
(45) Date of Patent: Sep. 1, 2015

(54) CONNECTOR FOR A CIRCUIT BOARD

(75) Inventor: Hidenori Kanda, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 71 days.

(21) Appl. No.: 13/808,952

(22) PCT Filed: Jul. 14, 2011

(86) PCT No.: PCT/JP2011/066078

§ 371 (c)(1),
(2), (4) Date: Jan. 8, 2013

(87) PCT Pub. No.: WO2012/008522

PCT Pub. Date: Jan. 19, 2012

(65) Prior Publication Data

US 2013/0115787 A1 May 9, 2013

(30) Foreign Application Priority Data

Jul. 15, 2010 (JP) ..... 2010-160693

(51) Int. Cl.

| | |
|---|---|
| ***H01R 12/00*** | (2006.01) |
| ***H01R 24/50*** | (2011.01) |
| ***H01R 24/44*** | (2011.01) |
| ***H01R 13/6474*** | (2011.01) |

(52) U.S. Cl.

CPC ..... *H01R 24/50* (2013.01); *H01R 13/6474* (2013.01); *H01R 24/44* (2013.01)

USPC ..... 439/63

(58) Field of Classification Search

CPC .. H01R 2103/00; H01R 24/50; H01R 9/0515; H01R 24/52; H01R 23/7073

USPC ..... 439/63, 581

See application file for complete search history.

(56) References Cited

U.S. PATENT DOCUMENTS 3,514,737 A * 5/1970 Renshaw, Jr. ..... 439/63
4,701,001 A * 10/1987 Verhoeven ..... 439/394

(Continued)

FOREIGN PATENT DOCUMENTS

CN 101278446 A 10/2008
JP 2002-270305 A 9/2002

(Continued)

OTHER PUBLICATIONS

International Search Report (PCT/ISA/210) dated Aug. 9, 2011, issued by the International Searching Authority in International Application No. PCT/JP2011/066078.

(Continued)

*Primary Examiner* — Abdullah Riyami
*Assistant Examiner* — Vladimir Imas
(74) *Attorney, Agent, or Firm* — Sughrue Mion, PLLC

(57) ABSTRACT

An inner terminal (54) of the present invention includes a horizontal part (C) held in an insulator part (55) covered with an outer terminal (56) and a suspending part (D) extended in a direction substantially orthogonal to the horizontal part (C) and having a lower end part connected to a signal patter of a circuit board. In the suspending piece (C) as a part opposed to one pair of side surface pieces (56*b*) suspended and extended in the outer terminal (56), plate shaped impedance adjusting pieces (54*c*) are integrally provided which respectively face the side surface pieces (56*b*) with prescribed spaces held from the side surface pieces.

2 Claims, 5 Drawing Sheets

(56) References Cited

U.S. PATENT DOCUMENTS

| | | | | |
|---|---|---|---|---|
| 4,741,703 | A * | 5/1988 | Johnescu et al. | 439/63 |
| 4,846,719 | A * | 7/1989 | Iwashita | 439/63 |
| 4,914,062 | A * | 4/1990 | Voltz | 439/607.11 |
| 5,133,679 | A * | 7/1992 | Fusselman et al. | 439/607.09 |
| 5,310,354 | A * | 5/1994 | Oswald, Jr. | 439/108 |
| 5,403,206 | A * | 4/1995 | McNamara et al. | 439/607.11 |
| 5,437,562 | A * | 8/1995 | Michael | 439/581 |
| 5,547,400 | A * | 8/1996 | Wright | 439/668 |
| 5,607,326 | A * | 3/1997 | McNamara et al. | 439/607.11 |
| 5,738,529 | A * | 4/1998 | Wedell et al. | 439/63 |
| 5,741,159 | A * | 4/1998 | Wright | 439/668 |
| 5,879,190 | A * | 3/1999 | Maruyama et al. | 439/582 |
| 5,904,594 | A * | 5/1999 | Longueville et al. | 439/607.1 |
| 6,478,624 | B2 * | 11/2002 | Ramey et al. | 439/607.1 |
| 6,491,530 | B2 * | 12/2002 | Koide et al. | 439/92 |
| 6,916,201 | B1 * | 7/2005 | Chu | 439/582 |
| 6,971,913 | B1 * | 12/2005 | Chu | 439/582 |
| 6,994,564 | B1 * | 2/2006 | Kan | 439/63 |
| 6,997,745 | B2 * | 2/2006 | Ikeda | 439/582 |
| 7,025,598 | B2 * | 4/2006 | Ikeda | 439/63 |
| 7,086,867 | B2 * | 8/2006 | Nakagawa et al. | 439/63 |
| 7,101,189 | B1 * | 9/2006 | Huss et al. | 439/63 |
| 7,108,514 | B2 * | 9/2006 | Chen et al. | 439/63 |
| 7,137,825 | B2 * | 11/2006 | Myer et al. | 439/63 |
| 7,150,648 | B1 * | 12/2006 | Hall et al. | 439/581 |
| 7,351,067 | B2 * | 4/2008 | Chen et al. | 439/63 |
| 7,357,641 | B2 * | 4/2008 | Kerekes et al. | 439/63 |
| 7,384,306 | B2 * | 6/2008 | Malstrom et al. | 439/578 |
| 7,549,868 | B1 * | 6/2009 | Ho | 439/63 |
| 7,621,753 | B1 * | 11/2009 | Pai | 439/63 |
| 7,753,690 | B2 * | 7/2010 | Maruyama et al. | 439/63 |
| 7,927,108 | B2 * | 4/2011 | Gong et al. | 439/63 |
| 7,988,455 | B2 * | 8/2011 | Blakborn | 439/63 |
| 8,206,189 | B2 * | 6/2012 | Kanda | 439/885 |
| 2008/0254668 | A1 | 10/2008 | Rosenberger | |

FOREIGN PATENT DOCUMENTS

| | | | |
|---|---|---|---|
| JP | 2007-35587 | A | 2/2007 |
| JP | 2007-122900 | A | 5/2007 |
| JP | 2008-84561 | A | 4/2008 |
| JP | 2009-64716 | A | 3/2009 |

OTHER PUBLICATIONS

Written Opinion (PCT/ISA/237) dated Aug. 9, 2011, issued by the International Searching Authority, in International Application No. PCT/JP2011/066078.

Communication from the State Intellectual Property Office of the People's Republic of China issued Aug. 14, 2014 in counterpart Chinese Patent Application No. 201180034858.4.

Communication from the Japanese Patent Office issued Sep. 24, 2014 in counterpart Japanese Patent Application No. 2010-160693.

Office Action issued on Jan. 6, 2015 in corresponding Japanese Patent Application No. 2010-160693 with English translation.

Office Action dated Mar. 12, 2015, issued by the State Intellectual Property Office of P.R. China in counterpart Chinese Application No. 201180034858.4.

* cited by examiner

CONNECTOR FOR A CIRCUIT BOARD

TECHNICAL FIELD

The present invention relates to a connector for a circuit board connected to a coaxial connector.

BACKGROUND ART

Usually, as a connector for a circuit board to which a coaxial connector is connected, is known a connector having an inner conductor terminal soldered and connected to a signal pattern of a printed circuit board, an outer conductor terminal soldered and connected to a ground pattern of the printed circuit board and an insulator part interposed between them and accommodated in a connector housing made of a resin (see patent literature 1). This connector for the circuit board will be described by referring to FIG. 10 and FIG. 11.

In the connector 11 for the circuit board, a connector terminal 16, is accommodated in the connector housing 17 made of a resin, which includes the inner conductor terminal 13 soldered and connected to the signal pattern on the printed circuit board, the outer conductor terminal 14 soldered and connected to the ground pattern on the printed circuit board and the insulator part 15 interposed between them. To the inner conductor terminal 13, a signal wire of a shielded electric wire which is not shown in the drawing is connected to transmit a high frequency signal. The outer conductor terminal 14 is connected to a shield wire of the shielded electric wire to cover a periphery of the inner conductor terminal 13 and electromagnetically shield it.

The inner conductor terminal 13 is formed substantially in the shape of an inverted L in which a suspending part 19 is suspended downward from a base end of a pin shaped horizontal part 18 by punching an electrically conductive plate material. The base end side of the pin shaped horizontal part 18 has a diameter formed to be a little larger than that of an end side thereof and is provided with an engaging protrusion 20.

The suspending part 19 is inserted into a through hole of the printed circuit board and connected to a desired signal pattern on the printed circuit board. Then, when the horizontal part 18 is connected to an inner conductor terminal of a mate side shield connector not shown in the drawing, an electric signal is delivered between the signal wire of the shielded electric wire and the signal pattern of the printed circuit board.

The insulator part 15 in which the inner conductor terminal 13 is accommodated is formed with an insulating material made of the resin having a prescribed dielectric constant and attached between the inner conductor terminal 13 and the outer conductor terminal 14 to insulate a part between them. The insulator part 15 has an accommodating chamber 22 having a vertically long opening surface 21 formed therein and a horizontal tube part 23 is extended and formed in a front side of the accommodating chamber 22.

In the horizontal tube part 23, an insert hole 24 into which the pin shaped horizontal part 18 of the inner conductor terminal 13 is inserted is opened and formed in a longitudinal direction and its rear side communicates with the accommodating chamber 22. When the horizontal part 18 of the inner conductor terminal 13 is inserted into the insert hole 24, the horizontal part is pressed in by the engaging protrusion 20 formed to be bulged in the base end side whose diameter is slightly larger than that of the end side. Thus, the inner conductor terminal 13 is held by the insulator part 15.

The outer conductor terminal 14 is formed in a cylindrical shape by drawing an electrically conductive plate material and then bending the plate material by a press, so that the insulator part 15 can be accommodated in an inner accommodating chamber 25. A front end part is a fitting part 26 fitted to an outer conductor terminal of the mate side shield connector. The end of the horizontal part 18 of the inner conductor terminal 13 inserted into the insert hole 24 of the insulator part 15 accommodated in the accommodating chamber 25 protrudes from the insulator part 15 and is arranged in the fitting part 26.

On an upper surface of a central part of the outer conductor terminal 14, an engaging piece 27 protrudes upward so as to be bent and deformed. In a rear edge of the upper surface of the outer conductor terminal 14, a bent piece 29 of such a size as to cover a rear opening part 28 is extended and formed. The bent piece 29 is bent downward to cover the insulator part 15 accommodated in the accommodating chamber 25 of the outer conductor terminal 14 from a rear part and close the rear opening part 28. Thus, a shielding performance of the connector 11 for the circuit board can be prevented from being deteriorated.

In a lower end of the rear part of the outer conductor terminal 14, one pair of right and left connecting tabs 30 and 30 protrude downward at positions shifting in the longitudinal direction, are inserted into through holes of the printed circuit board and electrically connected to the ground pattern.

The connector housing 17 is integrally formed with an insulating resin and accommodates and fixes the connector terminal 16 in which the inner conductor terminal 13 is held in the insulator part 15 and the insulator part 15 is accommodated in the outer conductor terminal 14.

In a rear part of the connector housing 17, a terminal accommodating chamber 31 opened in the longitudinal direction is formed to pass through so that the outer conductor terminal 14 may be inserted from a rear opening surface 32. On a ceiling surface of the terminal accommodating chamber 31, an engaging protrusion 33 is formed with which the engaging piece 27 of the outer conductor terminal 14 is engaged to prevent the outer conductor terminal 14 from slipping out.

In a front part of the terminal accommodating chamber 31, a hood part 34 whose front surface is opened is provided so that a front part of the mate side shield connector may be accommodated. On an upper end edge of the hood part 34, a stopper 35 is provided to protrude with which a connector housing of the mate side shield connector is engaged. The fitting part 26 of the outer conductor terminal 14 protrudes from the terminal accommodating chamber 31 to the hood part 34. The fitting part 26 can be fitted to the outer conductor terminal of the mate side shield connector accommodated in the hood part 34.

On both side surfaces of the connector housing 17, fixing members 36 which fix the connector 11 for the circuit board to the printed circuit board are formed integrally with the connector housing 17.

As shown in FIG. 10, on the printed circuit board 12, the signal pattern 44 and the ground pattern 45 are formed under a state that the signal pattern and the ground pattern are insulated from each other. To the signal pattern and the ground pattern respectively, the through holes 46 and 47 are electrically connected. Then, the suspending part 19 of the inner conductor terminal 13 of the connector 11 for the circuit board and the one pair of right and left connecting tabs 30 and 30 of the outer conductor terminal 14 are respectively inserted into the through holes 46 and 47 of the printed circuit board 12. At this time, ends of fixing parts 38 of the fixing members 36 formed integrally with the connector housing 17 are inserted into through holes 48 electrically conducted to the ground pattern 45. Thus, the ground pattern 45 of the printed circuit board 12 is connected to the outer conductor terminal 14, and the signal pattern 44 is connected to the inner conductor terminal 13, respectively.

LITERATURE OF RELATED ART

Patent Literature

Patent Literature 1: JP-A-2008-84561

SUMMARY OF THE INVENTION

Problems that the Invention is to Solve

The above-described usual connector for the circuit board has below-described problems to be solved.

Namely, when the inner conductor terminal 13 is formed in the shape of L as described above, it is difficult to cover an entire part of the inner conductor terminal 13 including the horizontal part 18, a connecting part (a bent part) to the suspending part 19 and the suspending part 19 with the outer conductor terminal 14 so as to obtain an uniform electrostatic capacity from the viewpoint of a restriction to the form and size of the connector housing 17. Thus, a mismatching of impedance is generated respectively in the parts of the connector for the circuit board, so that the impedance of the entire part of the connector is hardly set to a desired numerical value.

The present invention is devised by considering the above-described circumstances and it is an object of the present invention to provide a connector for a circuit board which can suppress a mismatching of impedance due to forms of an inner conductor terminal and an outer conductor terminal and can adjust the impedance to a desired numerical value.

Means for Solving the Problems

In order to achieve the above-described object, a connector according to the present invention is characterized by below-described (1) to (2).

(1) A connector including:

an outer terminal connected to a ground pattern of a circuit board;

an inner terminal connected to a signal pattern of the circuit board;

an insulator part interposed between the outer terminal and the inner terminal and a connector housing in which the outer terminal, the inner terminal and the insulator part are accommodated, wherein the outer terminal has side surface pieces extended toward the circuit board when the connector is attached to the circuit board and including end parts connected to the ground pattern, and the inner terminal has a horizontal part extended in parallel with the circuit board when the connector is attached to the circuit board and a suspending piece extended toward the circuit board from the horizontal part when the connector is attached to the circuit board and having an end part connected to the signal pattern and the suspending piece has impedance adjusting pieces opposed to the side surface pieces with prescribed spaces held thereto.

(2) A connector having the structure of the above-described (1), wherein a shield cover which can be attached to the outer terminal is further provided and the shield cover is opposed to at least a part of the suspending piece when the shield cover is attached to the outer terminal.

According to the connector having the structure of the above-described (1), since the impedance adjusting pieces of a previously calculated prescribed size are opposed to the side surface pieces so as to hold prescribed spaces to the side surface pieces, an electrostatic capacity to ground of the inner terminal to the outer terminal can be improved. Thus, for the impedance larger than a desired numerical value in an angular part in which the horizontal part is connected to the suspending part and a part in the vicinity of the suspending part, the impedance can be made to be the smaller than the desired numerical value in the vicinity of the impedance adjusting pieces. Accordingly, the impedance of an entire part of the connector can be adjusted to the desired numerical value.

Further, according to the connector having the structure of the above-described (2), since at least a part of the suspending piece of a previously calculated prescribed size is opposed to the shield cover so as to hold a prescribed space to the shield cover, the electrostatic capacity to ground of the inner terminal to the outer terminal can be improved.

Advantage of the Invention

According to the present invention, a mismatching of impedance due to the forms of the inner conductor terminal and the outer conductor terminal can be suppressed. As a result, a high frequency performance of an entire part of the connector for the circuit board can be improved.

The present invention is briefly explained as described above. Further, when a mode for carrying out the invention described below will be read by referring to the attached drawings, a detail of the present invention will be more clarified.

MODE FOR CARRYING OUT THE INVENTION

Figure 1:
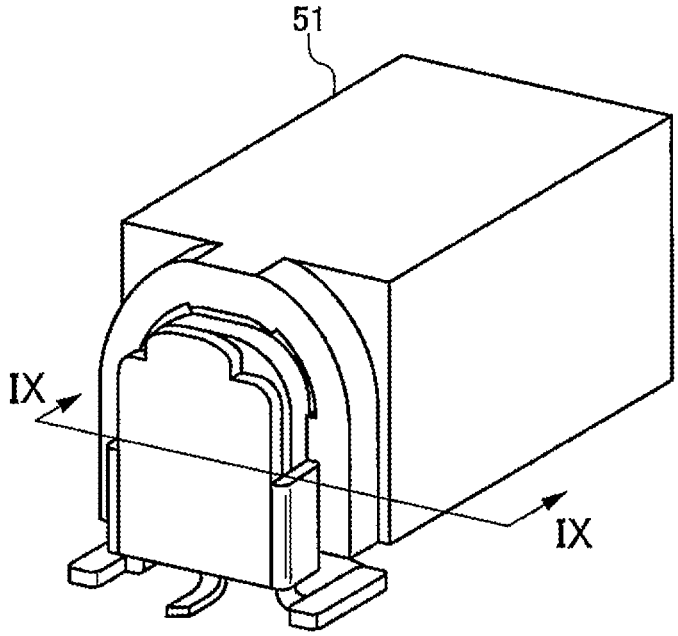
FIG. 1 is a perspective view showing a connector for a circuit board according to one exemplary embodiment of the present invention.

Now, a connector for a circuit board according to one exemplary embodiment of the present invention will be described below by referring to FIG. 1 to FIG. 9.

The connector for the circuit board according to the one exemplary embodiment of the present invention includes an inner terminal (an inner conductor terminal) soldered to a signal pattern on a circuit board (not shown in the drawing) to which the connector is attached, an outer terminal (an outer conductor terminal) soldered to a ground pattern on the circuit board, an insulator part interposed between the inner terminal and the outer terminal and a connector housing in which the outer terminal, the inner terminal and the insulator part are accommodated and to which a mate side connector (a coaxial connector, not shown in the drawing) is fitted.

Figure 2:
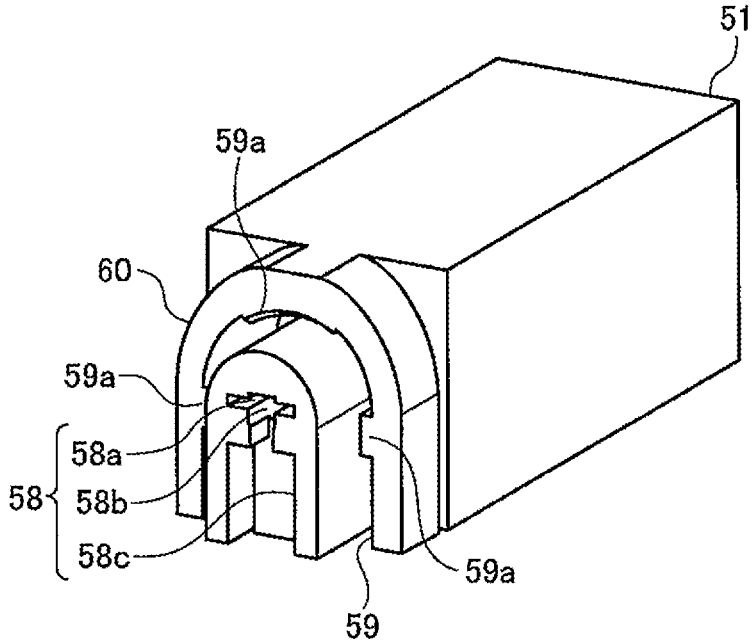
FIG. 2 is a perspective view showing a housing of the connector for the circuit board according to the one exemplary embodiment of the present invention.
Figure 9:
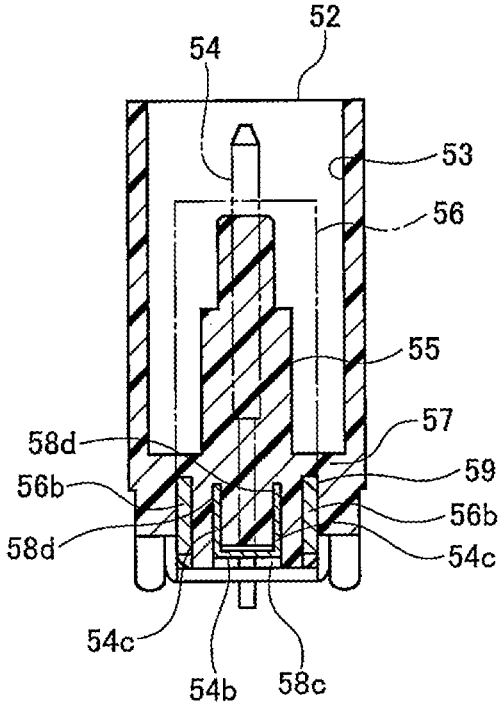
FIG. 9 is a sectional view taken along a line IX-IX in FIG. 1.
Figure 10:
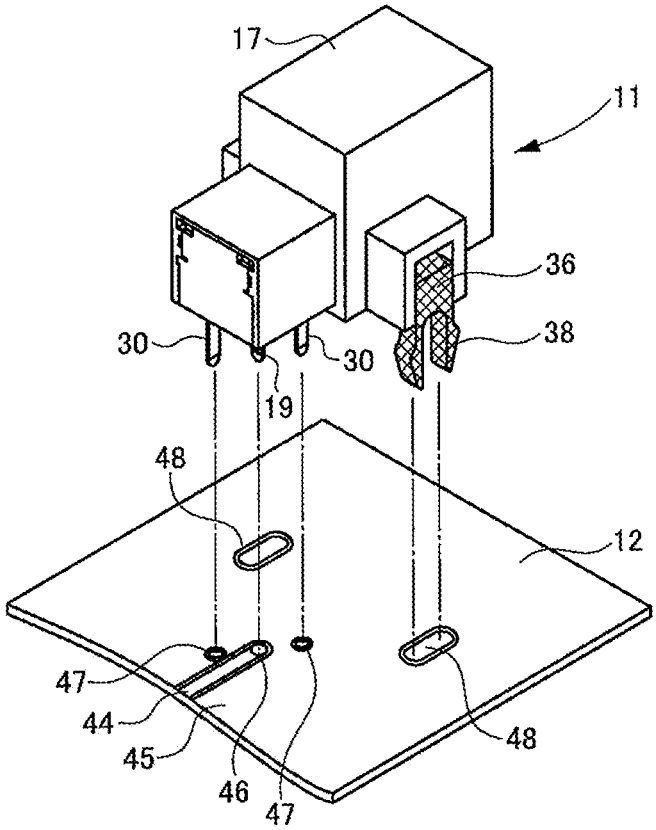
FIG. 10 is a perspective view showing a connecting structure of a usual shield connector for a board.
Figure 11:
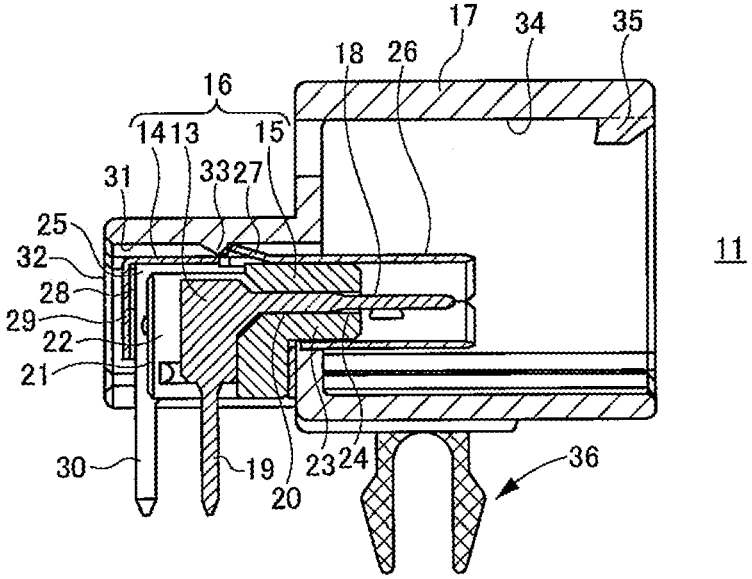
FIG. 11 is a sectional view of the shield connector for the board shown in FIG. 10.

The connector housing 51 of the above-described members is formed substantially in the shape of a rectangular parallelepiped as a molded product of a synthetic resin as shown in FIG. 2. The insulator part 55 is also formed integrally and simultaneously with the same synthetic resin at the time of forming the connector housing 51. As shown in FIG. 9, the connector housing 51 has a connector fitting part 53 having an opening part 52 at one end part (a front part). The connector fitting part 53 has a hollow shape to fit the mate side connector (not shown in the drawing) thereto. The insulator part 55 is allowed to protrude in a direction of a central line in the hollow part. The inner terminal (shown by a chain line) 54 is fixed to a central part of the insulator part 55 under a state the inner terminal passes through the central part except its end part.

Further, the outer terminal 56 is fixed in the connector housing 51 so as to cover the inner terminal 54 with a prescribed space provided between them. The connector fitting part 53 and the insulator part 55 are designed so as to meet the form and size of the mate side connector.

Figure 5:
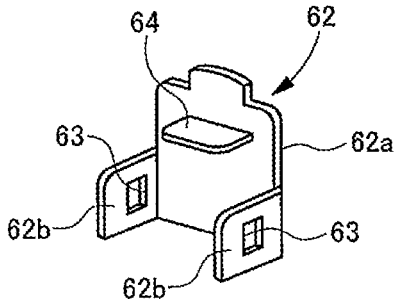
FIG. 5 is a perspective view showing a shield cover of the connector for the circuit board according to the one exemplary embodiment of the present invention.

On the other hand, a closed wall part 57 is formed in an opposite side to the above-described opening part 52 side of the connector housing 51 so as to close one end of the connector fitting part 53. The closed wall part 57 has a protruding part 60 of a forward rear circular form (an inverted U shape) as shown in FIG. 2 in an outer side surface part. In the protruding part 60 side, an inner terminal accommodating hole 58 and an outer terminal accommodating hole 59 are provided. The inner terminal accommodating hole 58 is horizontally formed so as to pass through the closed wall part 57 from an end face side of the protruding part 60. Further, the inner terminal accommodating hole 58 includes a slot 58*a* to which a protruding piece 64 of a shield cover 62 shown in FIG. 5 is inserted, a pin insert hole 58*b* to which a cylindrical round pin part 54*a* of the inner terminal 54 shown in FIG. 3 is inserted and a rectangular hole 58*c* and an insert hole 58*d* to which a wide part 54*b* and impedance adjusting pieces 54*c* of the inner terminal 54 are inserted.

Figure 8:
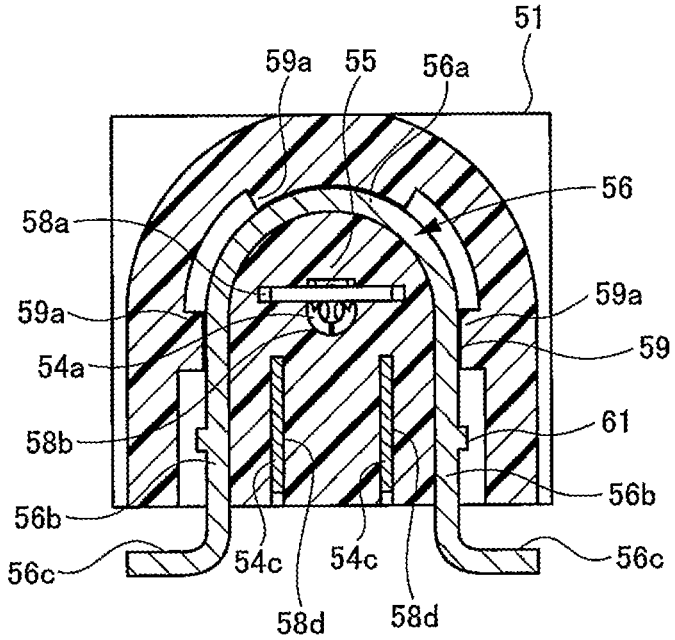
FIG. 8 is a sectional view taken along a line VIII-VIII in FIG. 7.

Further, as shown in FIG. 8 and FIG. 9, the slot 58*a* of the inner terminal accommodating hole 58 has such a form and depth as to be inserted by the protruding piece 64 of the shield cover 62. The pin insert hole 58*b* has such a depth as to be inserted by the cylindrical round pin part 54*a* of the inner terminal 54 and allow the round pin part 54*a* to protrude forward from an end of the insulator part 55. Further, the rectangular hole 58*c* has a depth into which the wide part 54*b* and the one pair of impedance adjusting pieces 54*c* of the inner terminal 54 can be inserted.

On the other hand, the outer terminal accommodating hole 59 is also horizontally formed so as to pass through the dosed wall part 57 from the end face side of the protruding part 60. The outer terminal accommodating hole 59 has a form into which a semi-cylindrical piece 56*a* of the outer terminal 56 shown in FIG. 4 and one pair of side surface pieces 56*b* connected to lower edges of a rear end of the semi-cylindrical piece 56*a* can be inserted. Further, three guide protrusions 59*a* are arranged so as to protrude to a central direction of the outer terminal accommodating hole 59. Thus, the outer terminal 56 can be smoothly inserted into the outer terminal accommodating hole 59 along the guide protrusions 59*a*, respectively.

Figure 3:
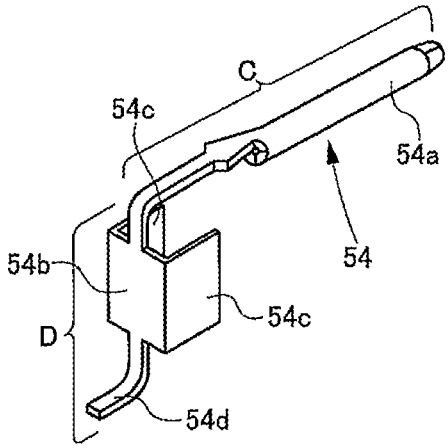
FIG. 3 is a perspective view showing an inner terminal of the connector for the circuit board according to the one exemplary embodiment of the present invention.

As shown in FIG. 3, the inner terminal 54 is formed in the shape of a crank as a whole and includes a horizontal part C and a suspending part D. The horizontal part C is a part extended in parallel with the circuit board when the connector according to the exemplary embodiment is attached to the circuit board. The suspending part D is a part extended toward the circuit board from the horizontal part C when the connector is attached to the circuit board and its end part is connected to the signal pattern of the circuit board. The horizontal part C has the round pin part 54*a* in the first half part. The round pin part 54*a* is inserted into a part of the slot 58*a* and the pin insert hole 58*b* shown in FIG. 7 and FIG. 8 and horizontally held by the connector housing 51. The suspending part D has the rectangular wide part 54*b* of a large area in a part thereof and the substantially rectangular impedance adjusting pieces 54*c* connected to right and left ends of the wide part 54*b*. The wide part 54*b* and the impedance adjusting pieces 54*c* are bent at right angles to each other to form substantially a shape of U. Further, a circuit board connecting piece 54*d* is horizontally connected to a lower end of the suspending part D of a lower part of the wide part 54*b*. The circuit board connecting piece 54*d* is soldered to the signal pattern of the circuit board. The round pin part 54*a*, the wide part 54*b*, the impedance adjusting pieces 54*c* and the circuit board connecting piece 54*d* are obtained by press molding of an electrically conductive plate.

Further, in the inner terminal 54, the round pin part 54*a* is inserted into the pin insert hole 58*b* of a rear surface of the closed wall part 57 shown in FIG. 2 and the impedance adjusting pieces 54*c* are inserted into the insert hole 58*d* from the rectangular hole 58*c* of the rear surface of the dosed wall part 57. Further, the wide part 54*b* is similarly fitted to the rectangular hole 58*c* of the rear surface of the dosed wall part 57. Thus, the inner terminal 54 is attached to the connector housing 51.

Figure 4:
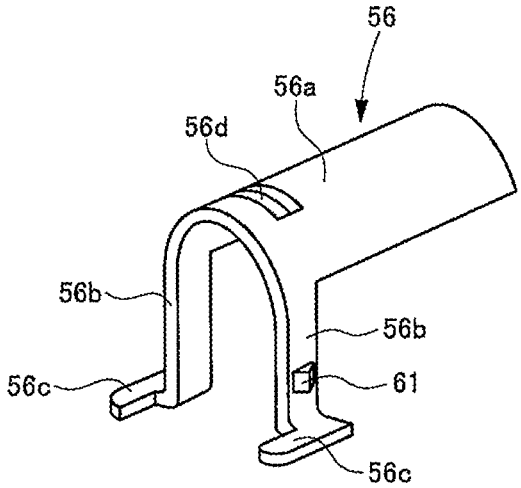
FIG. 4 is a perspective view showing an outer terminal of the connector for the circuit board according to the one exemplary embodiment of the present invention.

On the other hand, the outer terminal 56 includes, as shown in FIG. 4, the semi-cylindrical piece 56*a* and the one pair of side surface pieces 56*b* extended downward (toward the circuit board) at the one end of the semi-cylindrical piece 56*a*. The side surface pieces 56*b* hold a parallel state to each other. At lower ends thereof, somewhat short circuit board connecting pieces 56*c* are horizontally extended in opposite directions to each other. The circuit board connecting pieces 56*c* are soldered to the ground pattern on the circuit board (not shown in the drawing). Engaging pawls 61 respectively protrude on outer side surfaces of the side surface pieces 56*b*. The engaging pawls 61 have sizes and forms which can be fitted to engaging holes 63 provided in the shield cover 62 shown in FIG. 5. Further, an engaging hole 56*d* is formed so as to cut out a part of the semi-cylindrical piece 56*a*. In the engaging hole 56*d*, when the outer terminal 56 is attached to the connector housing 51, a protrusion provided in an inner wall of the insulator part 55 enters the engaging hole 56*d*. Thus, the outer terminal 56 is assuredly fixed to the connector housing 51.

In the outer terminal 56, an end part of the semi-cylindrical piece 56*a* is inserted to an entrance of the outer terminal accommodating hole 59 of the rear surface of the dosed wall part 57 shown in FIG. 2 and the side surface pieces 56*b* are also respectively inserted into a part in the vicinity of the entrance part of the outer terminal accommodating hole 59. Thus, the outer terminal 56 is attached to the connector housing 51. A state that the inner terminal 54 and the outer terminal 56 are attached to the connector housing 51 in such a way is shown in a perspective view of FIG. 7 and sectional views of FIG. 8 and FIG. 9.

Figure 6:
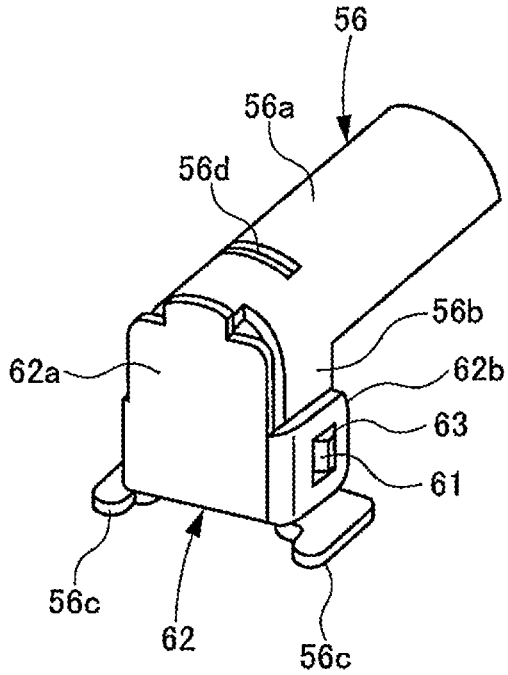
FIG. 6 is a perspective view showing the outer terminal to which the shield cover is attached in the connector for the circuit board according to the one exemplary embodiment of the present invention.
Figure 7:
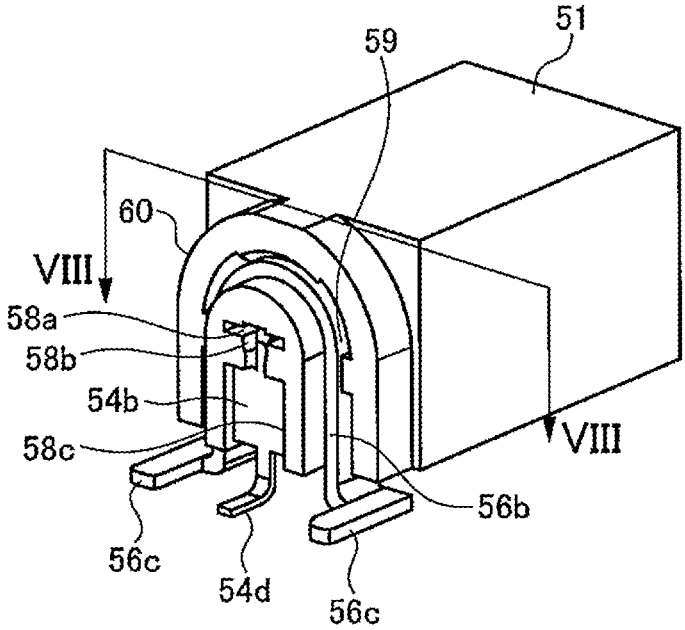
FIG. 7 is a perspective view showing a state that the inner terminal and the outer terminal are attached to the connector housing in the connector for the circuit board according to the one exemplary embodiment of the present invention.

As shown in FIG. 5, the shield cover 62 includes a dosing plate 62*a* and engaging pieces 62*b*. To both sides of a lower part of the dosing plate 62*a*, the engaging pieces 62*b* are connected in directions orthogonal to the dosing plate 62*a*. The engaging holes 63 are respectively formed at substantially central parts of the engaging pieces 62*b* and engaged with the engaging pawls 61 provided in the outer terminal 56. Thus, as shown in FIG. 6, the shield cover is attached to the outer terminal 56 so that the shield cover may be prevented from slipping out. Further, the protruding piece 64 is supported on an upper position of the closing plate 62*a* under a cantilever state. The protruding piece 64 has a size and form which can be inserted into the slot 58*a* of the connector housing 51 shown in FIG. 2 and FIG. 7.

As shown in FIG. 1, the shield cover 62 is attached to be opposed to the rear surface of the closed wall part 57 of the connector housing 51 in which the inner terminal 54 and the outer terminal 56 are accommodated and the wide part 54*b* of the inner terminal 54. This attachment is carried out by pushing the protruding piece 64 of the shield cover 62 to the slot 58*a* of the rear surface of the dosed wall part 57 and fitting the engaging holes 63 of the shield cover 62 to the engaging pawls 61 of the outer terminal 56 as shown in FIG. 4. A fitting state of the engaging pawls 61 and the engaging holes 63 is shown in FIG. 6.

In the connector for the circuit board having the above-described structure, a mismatching of impedance due to the forms of the inner conductor terminal and the outer conductor terminal can be adjusted by areas and spaces of the side surface pieces 56*b* of the outer terminal 56 and the impedance adjusting pieces 54*c* of the inner terminal 54 which are opposed to each other.

Namely, in the usual inner terminal which is not provided with the impedance adjusting pieces 54*c*, since an area of a part opposed to an outer terminal is small, an electrostatic capacity to ground of the inner terminal to the outer terminal in that part is low, so that high impedance arises. As compared therewith, in the present exemplary embodiment, since the impedance adjusting pieces 54*c* of a previously calculated prescribed size are opposed to the side surface pieces 56*b* of the outer terminal 56 so as to hold prescribed spaces from the side surface pieces, the electrostatic capacity to ground of the inner terminal 54 to the outer terminal 56 can be improved. Since an impedance Z is inversely proportional to an electrostatic capacity C ($Z=1/\omega C$), the impedance can be suppressed low to a previous value or smaller. Thus, for the impedance larger than a desired numerical value in an angular part in which the horizontal part C is connected to the suspending part D and a part in the vicinity of the suspending part D, the impedance can be made to be the smaller than the desired numerical value in the vicinity of the impedance adjusting pieces 54*c*. Thus, the impedance of an entire part of the connector for the circuit board of the present exemplary embodiment can be adjusted to the desired numerical value. Accordingly, a high frequency performance of the connector can be improved.

Further, in the connector for the circuit board having the above-described structure, the mismatching of impedance due to the forms of the inner conductor terminal and the outer conductor terminal can be also adjusted by areas and spaces of the wide part 54*b* of the opposed inner terminal 54 and the dosing plate 62*a* of the shield cover 62 attached to the outer terminal 56. In the present exemplary embodiment, since the wide part 54*b* of a previously calculated prescribed size is opposed to the closing plate 62*a* of the shield cover 62 so as to hold a prescribed space to the closing plate 62*a*, the electrostatic capacity to ground of the inner terminal 54 to the outer terminal 56 can be improved.

As described in the connector according to the exemplary embodiment of the present invention, even when a part arises which has the impedance deviating from the desired numerical value due to the forms of the inner terminal and the outer terminal, the deviating part can be cancelled to adjust the impedance of the entire part of the connector to the desired numerical value. As a result, the high frequency performance of the connector can be improved.

The present invention is described in detail by referring to the specific exemplary embodiment, however, it is to be understood to a person with an ordinary skill in the art that various changes or modifications may be made without departing from the spirit and scope of the present invention.

This application is based on Japanese Patent Application (JPA No. 2010-160693) filed on Jul. 15, 2010, and contents thereof are incorporated herein as a reference.

INDUSTRIAL APPLICABILITY

According to the connector of the present invention, the mismatching of impedance due to the forms of the inner conductor terminal and the outer conductor terminal can be suppressed. As a result, the high frequency performance of the entire part of the connector for the circuit board can be effectively improved.

DESCRIPTION OF REFERENCE NUMERALS AND SIGNS

51 . . . connector housing
52 . . . opening part
53 . . . connector fitting part
54 . . . inner terminal
54*a* . . . round pin part
54*b* . . . wide part
54*c* . . . impedance adjusting piece
54*d* . . . circuit board connecting piece
55 . . . insulator part
56 . . . outer terminal
56*a* . . . semi-cylindrical piece
56*b* . . . side surface piece
56*c* . . . circuit board connecting piece
56*d* . . . engaging hole
57 . . . closed wall part
58 . . . inner terminal accommodating hole
58*a* . . . slot
58*b* . . . pin insert hole
58*c* . . . rectangular hole
58*d* . . . insert hole
59 . . . outer terminal accommodating hole
59*a* . . . guide protrusion
60 . . . protruding part
61 . . . engaging pawl
62 . . . shield cover
62*a* . . . closing plate
62*b* . . . engaging piece
63 . . . engaging hole
64 . . . protruding piece

The invention claimed is:

1. A connector, comprising:

an outer terminal connected to a ground pattern of a circuit board;

an inner terminal connected to a signal pattern of the circuit board;

an insulator part interposed between the outer terminal and the inner terminal and a connector housing in which the outer terminal, the inner terminal and the insulator part are accommodated;

wherein the outer terminal has side surface pieces extended toward the circuit board when the connector is attached to the circuit board and including end parts connected to the ground pattern, and the inner terminal has a horizontal part extended in parallel with the circuit board when the connector is attached to the circuit board and a suspending piece extended toward the circuit board from the horizontal part when the connector is attached to the circuit board and having an end part connected to the signal pattern and the suspending piece has impedance adjusting pieces opposed to the side surface pieces with prescribed spaces held thereto.

2. The connector according to claim 1, wherein a shield cover which can be attached to the outer terminal is further provided and the shield cover is opposed to at least a part of the suspending piece when the shield cover is attached to the outer terminal.

* * * * *